US009801514B2

(12) United States Patent
McIver

(10) Patent No.: US 9,801,514 B2
(45) Date of Patent: Oct. 31, 2017

(54) VACUUM CLEANER FILTER HOUSING

(71) Applicant: TECHTRONIC INDUSTRIES CO. LTD., Tsuen Wan, New Territories (HK)

(72) Inventor: Justin D. McIver, Hudson, OH (US)

(73) Assignee: Techtronic Industries Co. Ltd., Tsuen Wan, New Territories (HK)

( * ) Notice: Subject to any disclaimer, the term of this patent is extended or adjusted under 35 U.S.C. 154(b) by 711 days.

(21) Appl. No.: 14/258,540

(22) Filed: Apr. 22, 2014

(65) Prior Publication Data

US 2014/0310910 A1 Oct. 23, 2014

Related U.S. Application Data

(60) Provisional application No. 61/814,673, filed on Apr. 22, 2013.

(51) Int. Cl.

| | |
|---|---|
| ***A47L 9/10*** | (2006.01) |
| ***A47L 9/14*** | (2006.01) |
| ***A47L 9/26*** | (2006.01) |
| ***A47L 9/12*** | (2006.01) |

(52) U.S. Cl.

CPC ..... *A47L 9/1409* (2013.01); *A47L 9/122* (2013.01); *A47L 9/1445* (2013.01); *A47L 9/26* (2013.01); *Y10T 29/49826* (2015.01)

(58) Field of Classification Search

CPC ..... A47L 9/26; A47L 9/122; A47L 9/1409; A47L 9/1445; A47L 9/10; Y10T 29/49826

USPC ..... 15/347, 353

See application file for complete search history.

(56) References Cited

U.S. PATENT DOCUMENTS

| | | | |
|---|---|---|---|
| 3,856,488 | A | 12/1974 | Kato et al. |
| 4,209,875 | A | 7/1980 | Pugh et al. |
| 5,230,722 | A | 7/1993 | Yonkers |
| 5,855,634 | A | 1/1999 | Berfield |
| 6,553,611 | B2 | 4/2003 | Huebsch et al. |
| 6,829,805 | B2 | 12/2004 | Yang |
| 7,105,034 | B2 | 9/2006 | Jung et al. |
| 7,258,714 | B2 | 8/2007 | Genn et al. |
| 7,797,791 | B2 | 9/2010 | White et al. |
| 7,799,107 | B2 | 9/2010 | Corney et al. |
| 7,905,936 | B2 | 3/2011 | Coulonvaux et al. |
| 7,908,705 | B2 | 3/2011 | VanderBaan |

(Continued)

OTHER PUBLICATIONS

Chinese Patent Office Action for Application No. 201480002766.1 dated Feb. 16, 2016 (18 pages).

(Continued)

*Primary Examiner* — David Redding

(74) *Attorney, Agent, or Firm* — Michael Best & Friedrich LLP

(57) ABSTRACT

A vacuum cleaner includes a motor housing, a motor and fan assembly in communication with the motor housing, a housing forming a receptacle in fluid communication with the motor housing, and a filter assembly removably insertable into the receptacle. The filter assembly includes a filter supporting a filter. The filter assembly further includes a seal and a lock member movable relative to the tray between a locked position and an unlocked position. Movement of the lock member to the locked position engages the seal with the housing when the filter assembly is inserted in the receptacle.

18 Claims, 7 Drawing Sheets

(56) References Cited

U.S. PATENT DOCUMENTS

| | | | |
|---|---|---|---|
| 8,021,455 | B2 | 9/2011 | Adamek et al. |
| 8,075,650 | B2 | 12/2011 | Hale |
| 8,343,247 | B2 | 1/2013 | Peteln |
| 9,155,433 | B2 * | 10/2015 | Wofford ..... A47L 9/122 |
| 2004/0148914 | A1 | 8/2004 | Lim et al. |
| 2005/0022337 | A1 | 2/2005 | Roney et al. |
| 2006/0016042 | A1 | 1/2006 | Bruneau |
| 2006/0277874 | A1 | 12/2006 | Yoo |
| 2007/0113526 | A1 | 5/2007 | Gierer |
| 2008/0010958 | A1 | 1/2008 | Fester et al. |
| 2008/0307597 | A1 | 12/2008 | Davidshofer et al. |
| 2009/0265882 | A1 | 10/2009 | Rhea et al. |
| 2010/0281647 | A1 | 11/2010 | Lee |
| 2011/0083408 | A1 | 4/2011 | Raether et al. |
| 2011/0219578 | A1 | 9/2011 | Liu et al. |
| 2011/0258975 | A1 | 10/2011 | Lundgren et al. |
| 2012/0023701 | A1 | 2/2012 | Lenkiewicz et al. |
| 2012/0170009 | A1 | 7/2012 | Katsura et al. |
| 2012/0247384 | A1 | 10/2012 | Bosses |
| 2014/0143977 | A1 | 5/2014 | Wofford et al. |

OTHER PUBLICATIONS

International Search Report and Written Opinion for Application No. PCT/US2014/034941 dated Aug. 11, 2014 (11 pages).
European Patent Office Examination Report for Application No. 14726287.7 dated Dec. 21, 2016 (4 pages).

* cited by examiner

VACUUM CLEANER FILTER HOUSING

CROSS-REFERENCE TO RELATED APPLICATIONS

This application claims priority to U.S. Provisional Patent Application No. 61/814,673 filed on Apr. 22, 2013, the entire content of which is incorporated herein by reference.

BACKGROUND

The present invention relates to vacuum cleaners, and more specifically to vacuum cleaners including removable filter housings.

Vacuum cleaners are typically used to clean floor surfaces by generating suction to draw air and dirt through a suction nozzle. The dirt is separated from the air inside the vacuum cleaner, and clean air is discharged from the vacuum cleaner.

SUMMARY

The invention provides, in one aspect, a vacuum cleaner including a motor housing, a motor and fan assembly in communication with the motor housing, a housing forming a receptacle in fluid communication with the motor housing, and a filter assembly removably insertable into the receptacle. The filter assembly includes a filter housing supporting a filter. The filter assembly further includes a seal and a lock member movable relative to the filter housing between a locked position and an unlocked position. Movement of the lock member to the locked position engages the seal with the housing when the filter assembly is inserted in the receptacle.

The invention provides, in another aspect, a vacuum cleaner including a motor housing, a motor and fan assembly supported by the motor housing, a housing forming a receptacle in fluid communication with the motor housing, and a filter assembly removably insertable into the receptacle. The filter assembly includes a filter housing having a tray, a filter disposed within the tray, a seal, and a lock member movable relative to the tray between a locked position and an unlocked position. Movement of the lock member towards the locked position changes a relative spacing between the lock member and the tray.

The invention provides, in another aspect, a method of installing a filter assembly into a vacuum cleaner. The method includes inserting a filter assembly into a receptacle of a vacuum cleaner, moving a lock member along a first axis relative to a front portion of a filter housing of the filter assembly causing a tray to move relative to the front portion along a second axis normal to the first axis, increasing the distance between the lock member and the tray within the receptacle, and compressing a seal disposed on the tray.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
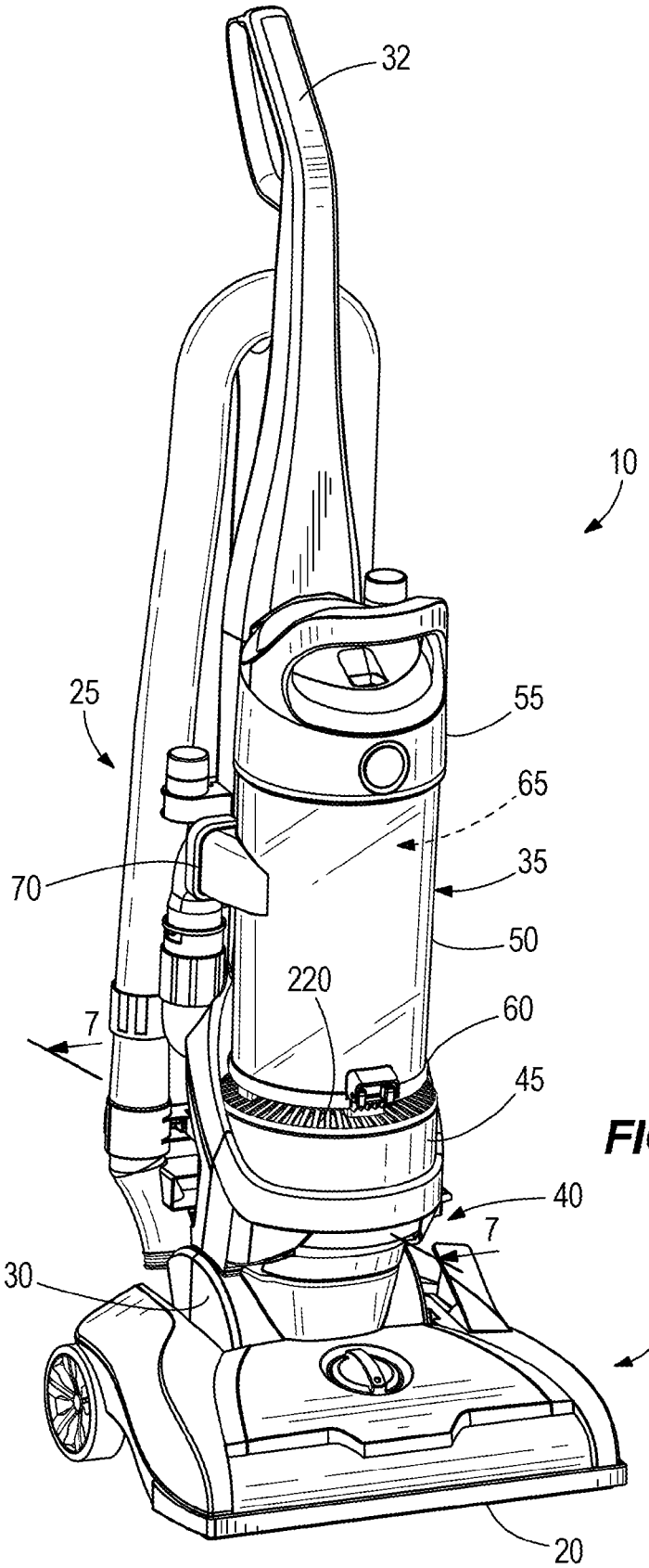
FIG. 1 is a perspective view of a vacuum cleaner according to an embodiment of the invention.

FIG. 1 illustrates a vacuum cleaner 10 including a base assembly 15 having a nozzle 20, an upper housing 25, a motor housing 30, and a motor and fan assembly 31 (FIG. 9) supported within the motor housing 30. The motor and fan assembly 31 is operable to draw an airflow through the nozzle 20 to pick up dust and debris from a surface to be cleaned. While the illustrated vacuum cleaner 10 is configured as an upright vacuum cleaner, the vacuum cleaner 10 can have any other configuration, such as a canister vacuum cleaner, a handheld vacuum cleaner, a central vacuum cleaner, and the like. In addition, the vacuum cleaner 10 can include any suitable combination and arrangement of vacuum cleaner components.

With continued reference to FIG. 1, the upper housing 25 includes a handle 32, a dirt cup assembly 35, a filter assembly 40, and a cord reel housing 45. The dirt cup assembly 35 is detachably secured to the upper housing 25 and includes a cylindrical container 50, a cover 55, a bottom lid 60, and a cyclone assembly 65. The cylindrical container 50 has an inlet 70 that receives the airflow and any entrained debris drawn through the nozzle 20. The cyclone assembly 65 separates the entrained debris from the airflow. The cyclone assembly 65 can include a single cyclone or multiple cyclones arranged in series or in parallel with each other.

Figure 2:
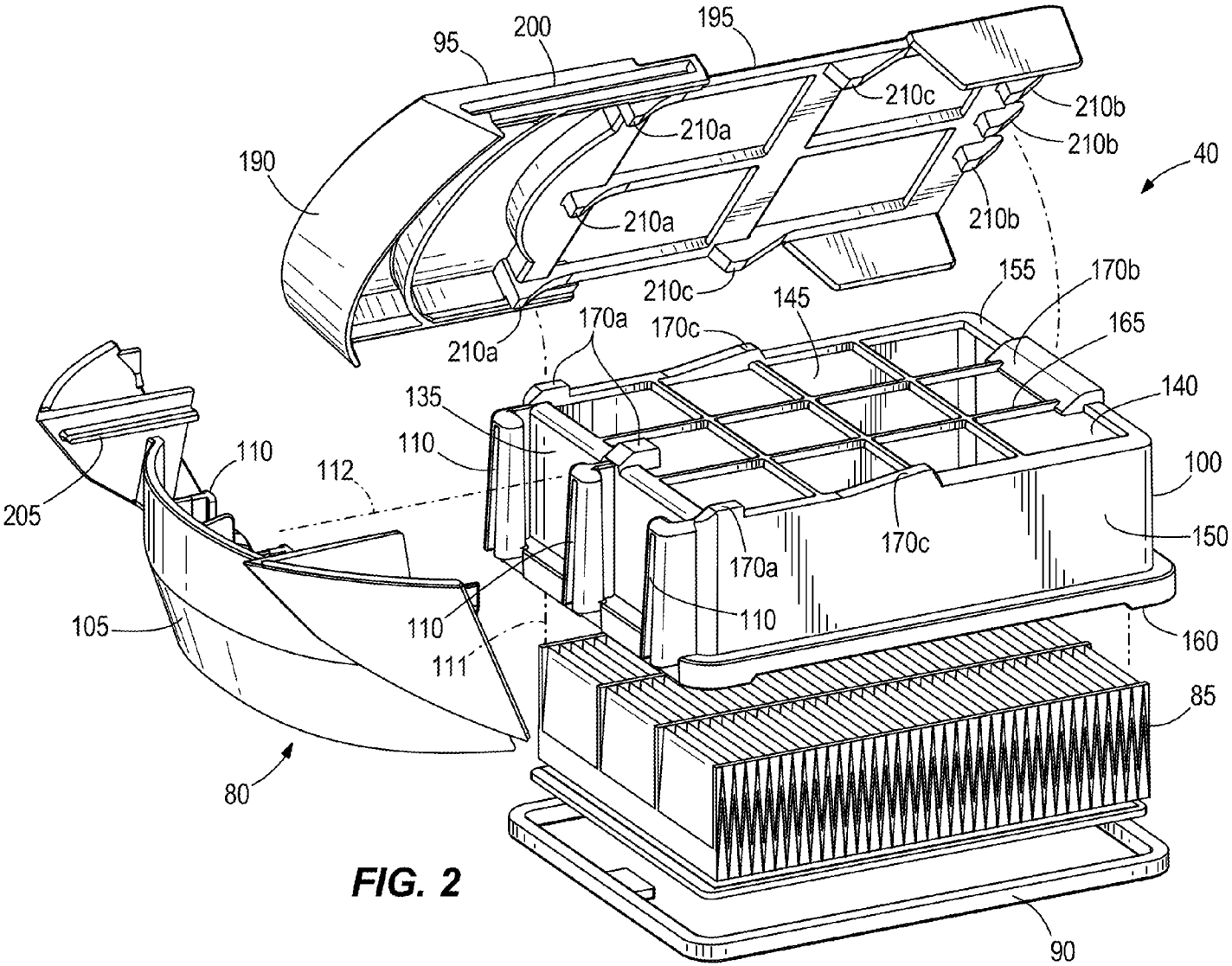
FIG. 2 is an exploded view of a filter assembly of the vacuum cleaner of FIG. 1.
Figure 3:
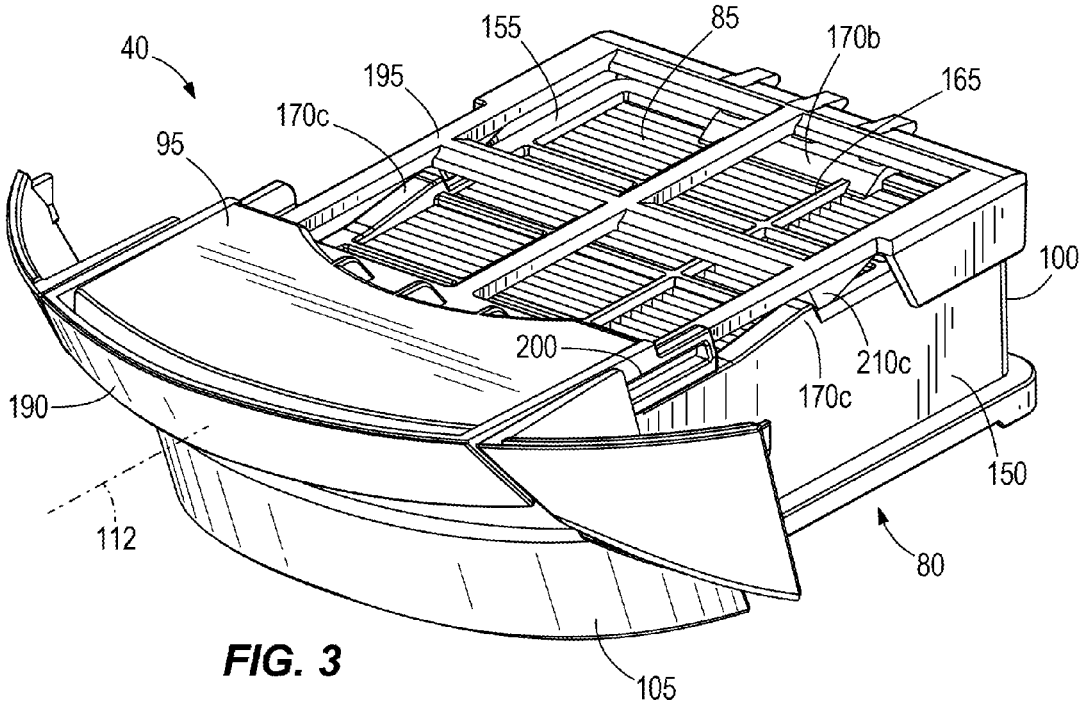
FIG. 3 is a perspective view of the filter assembly of FIG. 2, with a lock member of the filter assembly in a locked position.
Figure 9:
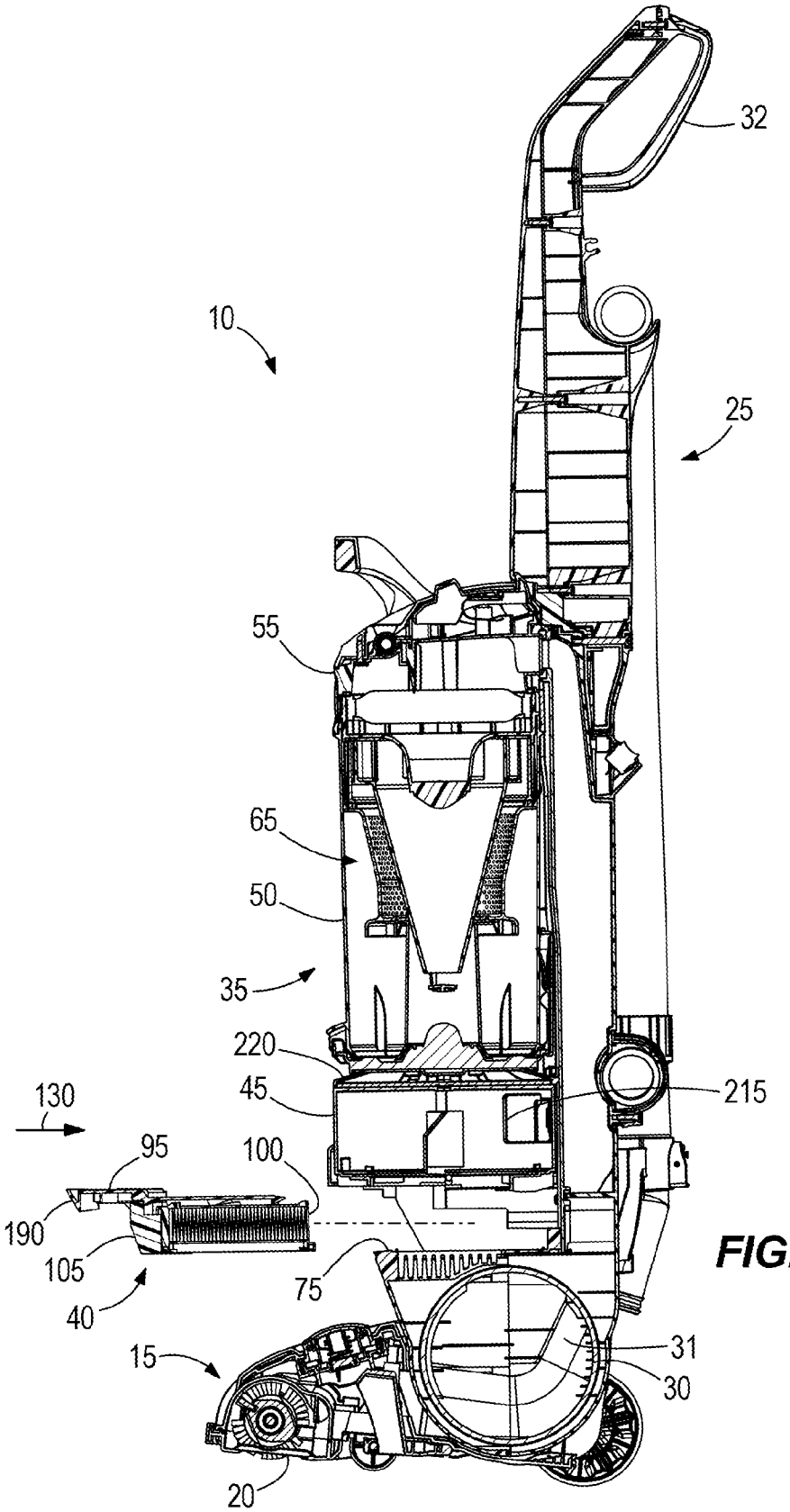
FIG. 9 is a cross-sectional view of the vacuum cleaner of FIG. 1 with the filter assembly removed.

The filter assembly 40 is removably coupled to a receptacle 75 in the upper housing 25 and is in fluid communication with the motor and fan assembly 31 (FIG. 9). The filter assembly 40 includes a filter housing 80 supporting a filter 85, a seal 90, and a lock member 95 movable relative to the filter housing between a locked position and an unlocked position. (FIG. 2). The filter assembly 40 is disposed downstream of the motor and fan assembly 31 to purify the airflow before it is exhausted to the surrounding environment. As described in greater detail below, the filter assembly 40 is removable to allow cleaning or replacement of the filter 85. The illustrated filter 85 is a rectangular, pleated filter; however, other shapes and varieties of filters can be used.

With reference to FIGS. 2-6, one embodiment of the filter housing 80 may include a tray portion 100 for accommodating the filter 85 and a contoured front portion 105. The contoured front portion 105 is shaped to match the contour of the upper housing 25 when the filter assembly 40 is installed in the receptacle 75, or other shape as desired for the application. The tray 100 is coupled to the front portion 105, and the front portion 105 may be integral with the tray portion 100. In the illustrated embodiment, the tray 100 is coupled to the front portion 105 by interlocking rails 110, such that the tray 100 is movable relative to the front portion 105 along a first axis 111 but moves together with the front portion 105 along a second axis 112 normal to the first axis 111 (FIG. 2). The illustrated tray 100 is rectangular and has a front wall 135, a rear wall 140, and side walls 145, 150 extending between the front and rear walls 135, 140. The filter housing 80 also includes a top side 155 (the downstream side) and a bottom side 160 (the upstream side). In other embodiments, the front wall 135 of the tray portion 100 is shaped to match the contour of the upper housing 25 when the filter assembly 40 is installed in the receptacle 75, or other shape as desired for the application omitting the contoured front portion 105. A support grid 165 may span between the walls 135, 140, 145, 150 at the top side 155 of the tray 100. The support grid 165 retains filter material within the tray 100 without inhibiting the airflow through the filter 85. The filter housing 80 further includes a plurality of wedge-like cam portions 170*a*, 170*b*, 170*c* respectively located on the front wall 135, the rear wall 140, and the side walls 145, 150 of the filter housing 80. In one alternative, the plurality of wedge-like cam portions 170*a*, 170*b*, 170*c* may be positioned along the side walls 145, 150 of the filter housing. The cam portions 170*a*, 170*b*, 170*c* are engageable with the lock member 95 to affect movement of the tray 100 relative to the front portion 105 along the first axis 111, as described in greater detail below. The filter 85 may be affixed to or integral with the filter housing 80. Alternatively, the filter 85 may be removeable from the filter housing 80.

Figure 5:
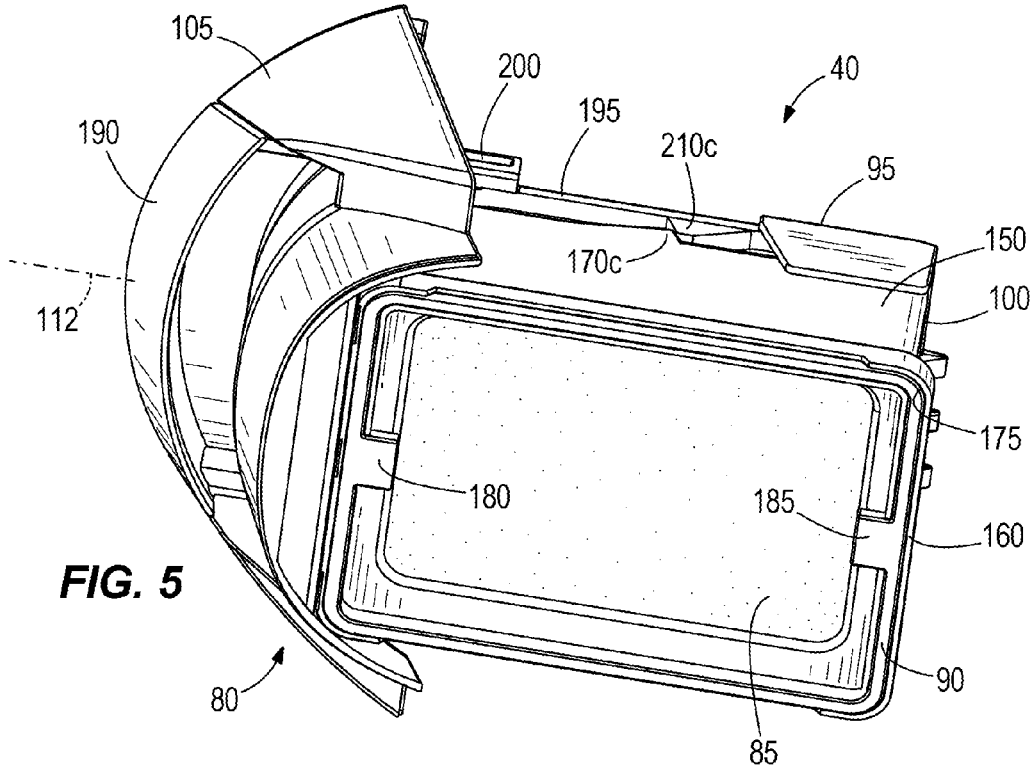
FIG. 5 is a bottom perspective view of the filter assembly of FIG. 3.
Figure 6:
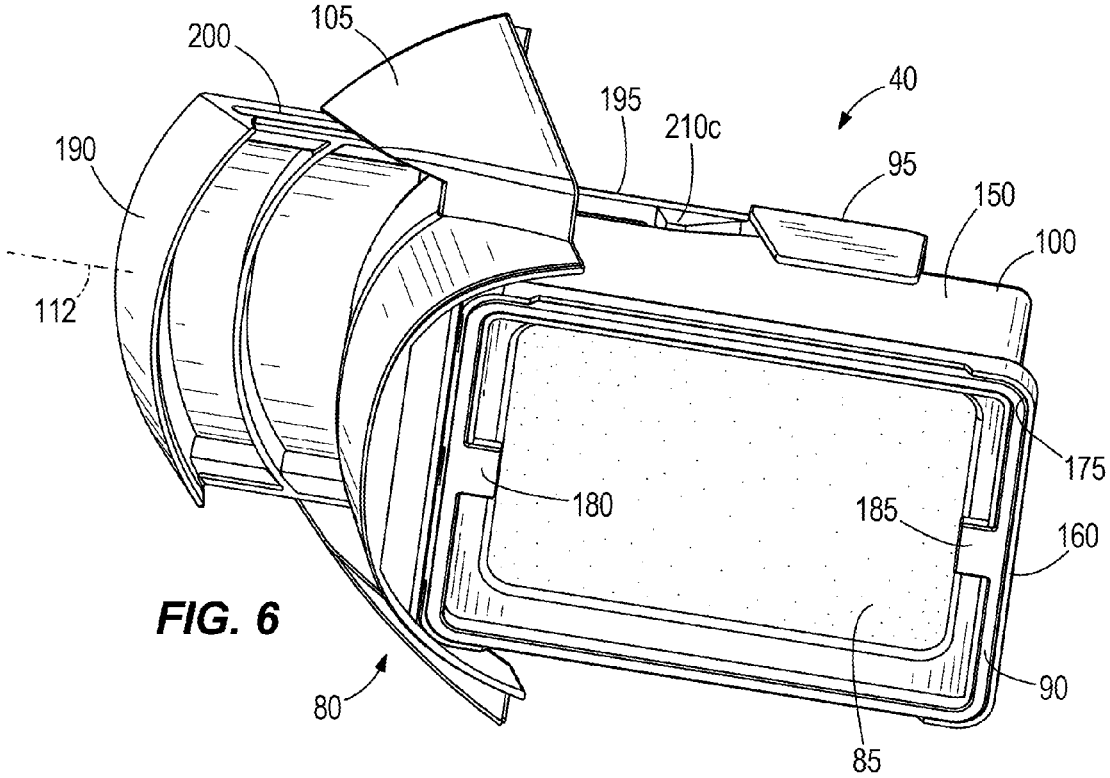
FIG. 6 is a bottom perspective view of the filter assembly of FIG. 4.

Best illustrated in FIGS. 5 and 6, a groove 175 is formed in the bottom side 160 of the tray 100 for receiving the seal 90. In the illustrated embodiment, the seal 90 is an elastomeric material; however, other types of seals can be used. The seal 90 includes a front tab 180 and a rear tab 185 that retain the filter 85 within the tray 100. The tabs 180, 185 are integrally formed with the seal 90 and are deformable to permit removal and replacement of the filter 85. In other embodiments, the tabs 180, 185 can be formed separately from the seal 90 as part of the tray 100, or the filter 85 can be retained by any other suitable means.

With reference to FIG. 2, the lock member 95 is slidably coupled to the filter assembly 80 operatively engageable with the plurality of wedge-like cam portions 170*a*, 170*b*, 170*c*. The lock member 95 includes a handle 190 and an actuating portion 195 extending from the handle 190. Slots 200 in the sides of the handle 190 engage with corresponding rails 205 on the front portion 105 to slidably couple the lock member 95 to the filter housing 80. In the illustrated embodiment, the lock member is positioned such that the actuating portion 195 is extending along and slidable relative to the top side 155 of the filter housing 80. The lock member 95 is slidable along the axis 112 between a locked position (FIGS. 3, 5, and 7) and an unlocked position (FIGS. 4, 6, and 8), to an extent limited by the length of the slots 200. The actuating portion 195 includes wedge-like cam portions 210*a*, 210*b*, 210*c* that slidably engage the respective the cam portions 170*a*, 170*b*, 170*c* of the tray 100 as the lock member 95 moves toward the locked position.

With reference to FIG. 9, the cord reel housing 45 is situated between the filter assembly 40 and the dirt cup assembly 35 on the upper housing 25. The cord reel housing 45 is generally cylindrical in shape and contains a cord reel 215 that stores and dispenses a power cord (not shown) that provides power to the motor and fan assembly 31. The cord reel housing 45 is located downstream of the filter assembly 40 such that the purified airflow exiting the filter assembly 40 passes through the cord reel housing 45 to cool the cord reel 215. The cord reel housing 45 includes a plurality of exhaust openings 220 arranged around its periphery to exhaust the purified airflow to the surrounding environment.

Figure 4:
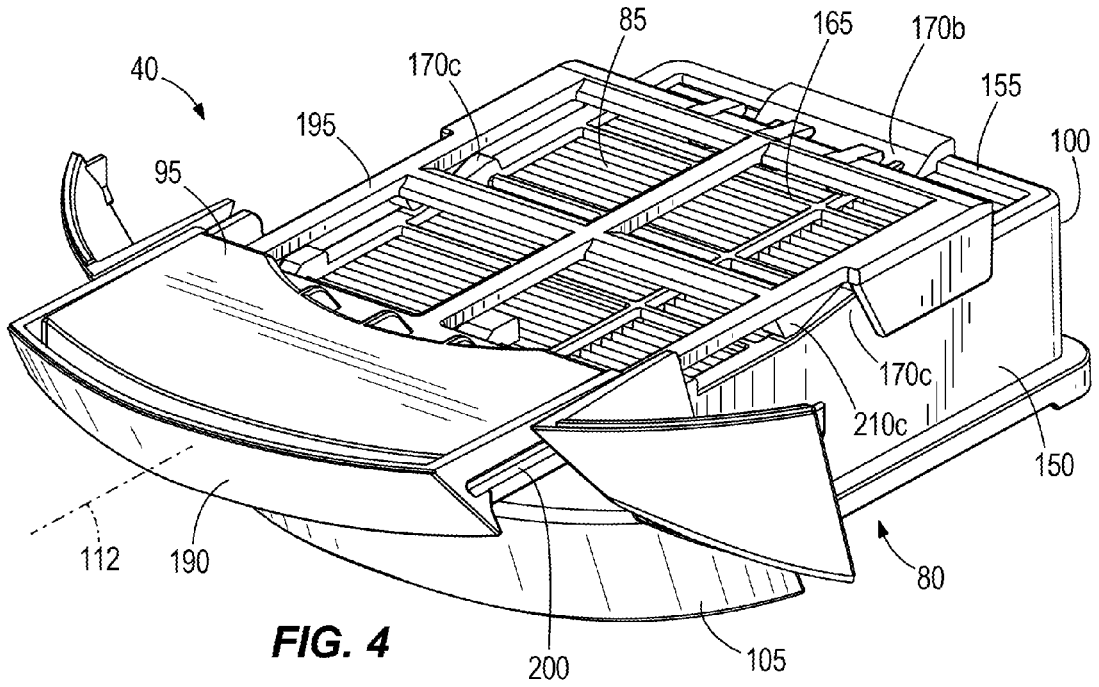
FIG. 4 is a perspective view of the filter assembly of FIG. 2, with the lock member in an unlocked position.

Operation of the filter assembly 40 will now be described with reference to FIGS. 7-9. To lock the filter assembly 40 in the receptacle 75, a user grasps the handle 190 in the unlocked position (such as shown in FIGS. 4 and 6) and pushes the lock member 95 towards the locked position shown in FIG. 7 (i.e., in the direction of arrow 130). The cam portions 210*a*, 210*b*, 210*c* of the lock member 95 bear against the cam portions 170*a*, 170*b*, 170*c* of the tray 100 to increase a relative spacing D between the lock member 95 and the filter housing 80. In other words, the tray portion 100 moves away from the lock member 95 in the direction of arrow 120. In the illustrated embodiment, the tray 100 moves relative to the front portion 105 as the slots 200 in the sides of the handle 190 retain the corresponding rails 205 on the front portion 105. The movement of the filter housing 80 away from the lock member 95 compresses the seal 90 between the tray portion 100 and a filter seat (not shown) of the receptacle 75 to provide an improved seal between the seal 90 and the filter seat.

Figure 7:
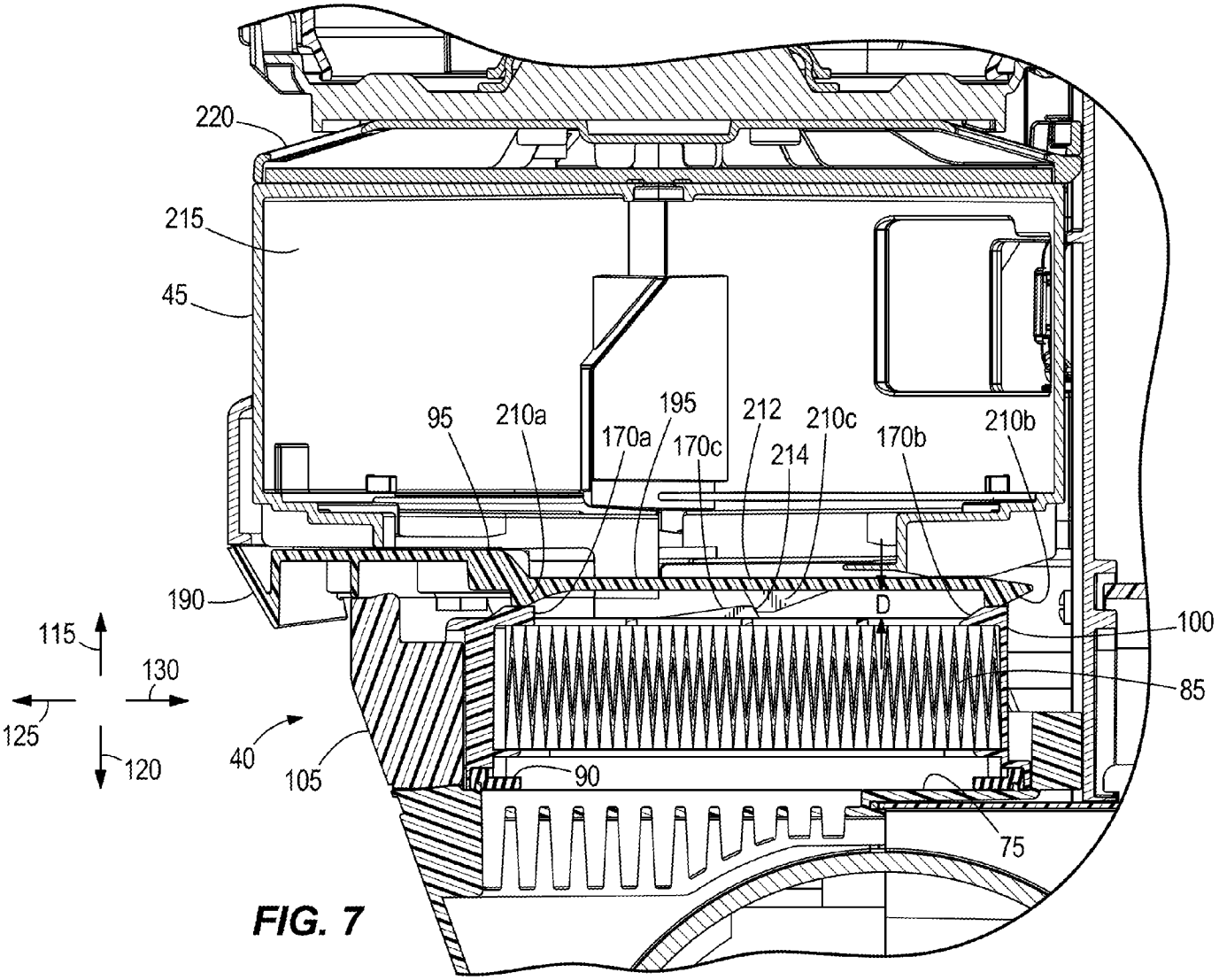
FIG. 7 is a cross-sectional view taken along line 7-7 in FIG. 1, with the lock member in the locked position.
Figure 8:
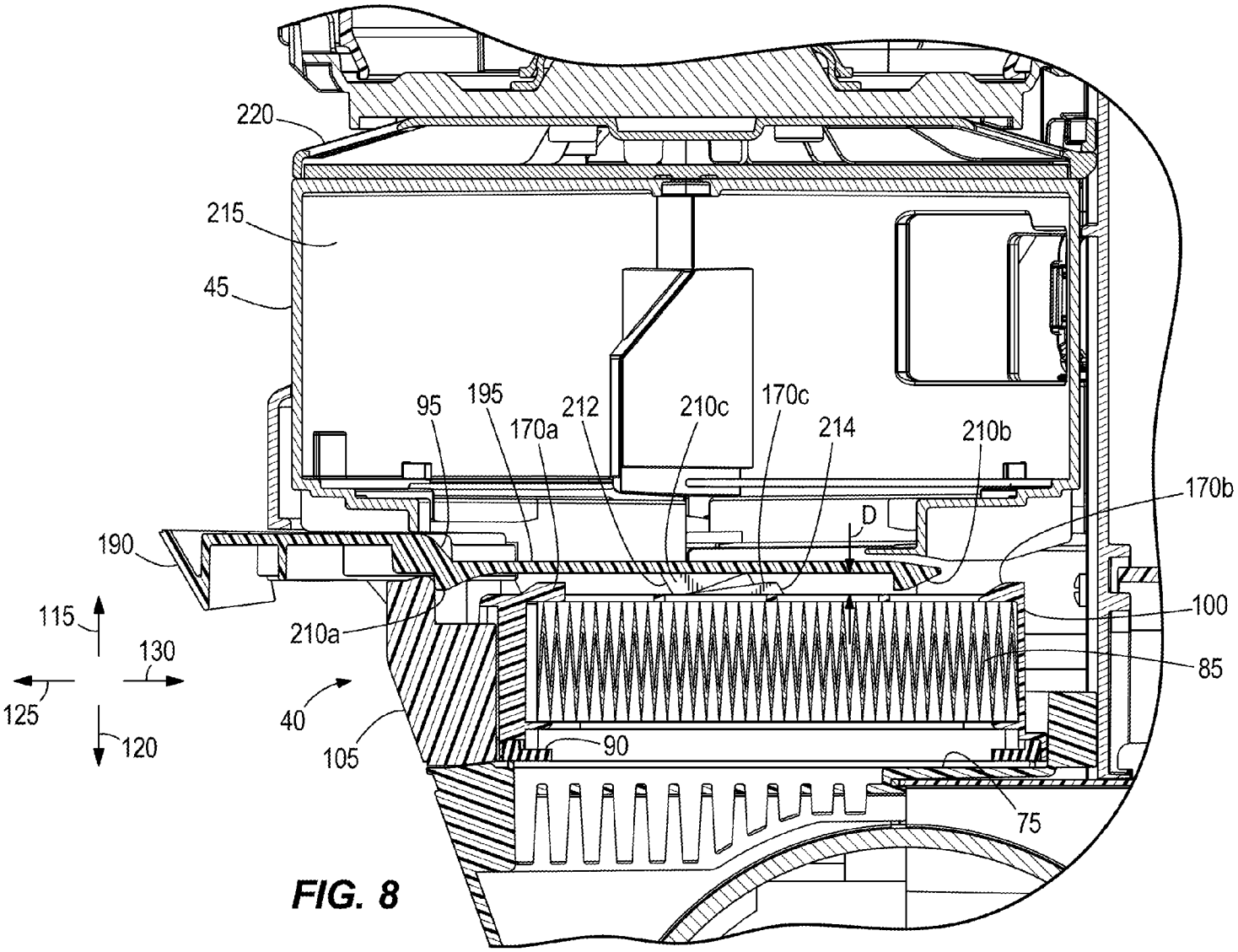
FIG. 8 is a cross-sectional view taken along line 7-7 in FIG. 1, with the lock member in the unlocked position.

In the illustrated embodiment, the cam portions 170*c* and 210*c* function as detents to retain the lock member 95 in the locked position illustrated in FIG. 7. When the lock member 95 approaches the locked position, the cam portions 210*c* ride over the cam portions 170*c* such that a front side 212 of each of the cam portions 210*c* engages a back side 214 of each of the cam portions 170*c*. This provides a tactile indication that the lock member 95 has reached the locked position and provides resistance when moving the lock member 95 to the unlocked position, as described below.

To remove the filter assembly 40 (e.g., to clean or replace the filter 85), the user grasps the handle 190 and pulls the lock member 95 in the direction of arrow 125 (FIG. 7). As the lock member 95 moves from the locked position towards the unlocked position (i.e., in the direction of arrow 125), the front sides 212 of the cam portions 210*c* slide up the back sides 214 of the cam portions 170*c*. The center of the actuating portion 195 deflects upward (in the direction of arrow 115) to accommodate this movement, providing resistance when unlocking the filter assembly 40. As the lock member 95 continues to move in the direction of arrow 125, the cam portions 210*a*, 210*b*, 210*c* of the lock member 95 ride down the cam portions 170*a*, 170*b*, 170*c* of the tray 100. This decreases the spacing D between the lock member 95 and the tray 100, allowing the seal 90 to decompress, and facilitating removal of the filter assembly 40 without damaging the seal 90 (FIG. 8). Once the lock member 95 is in the unlocked position, the user continues to pull the handle 190 in the direction of arrow 125 to remove the entire filter assembly 40 from the receptacle 75 (FIG. 9).

To reinsert the filter assembly 40, the user aligns the filter assembly 40 with the receptacle 75, and pushes on the front portion 105 in the direction of arrow 130. The receptacle 75 is sized so that if the lock member 95 is in the locked position, the user will be unable to insert the filter assembly 40 into the receptacle 75 and must first move the lock member 95 towards the unlocked position. Once the filter assembly 40 is positioned in the receptacle 75 (FIG. 8), the user pushes on the handle 190 in the direction of arrow 130 to move the lock member 95 toward the locked position as described above.

Various features of the invention are set forth in the following claims.

What is claimed is:

1. A vacuum cleaner comprising:

a motor housing;

a motor and fan assembly in communication with the motor housing;

a housing forming a receptacle in fluid communication with the motor housing; and a filter assembly removably insertable into the receptacle, the filter assembly including a filter housing supporting a filter and including a tray portion, a front portion movably coupled to the tray portion such that the tray portion is movable relative to the front portion along a first axis, a seal, and a lock member movable relative to the filter housing between a locked position and an unlocked position along a second axis that is normal to the first axis, wherein movement of the lock member to the locked position engages the seal with the housing when the filter assembly is inserted in the receptacle.

2. The vacuum cleaner of claim 1, wherein movement of the lock member to the locked position compresses the seal between the filter housing and the housing when the filter assembly is inserted in the receptacle.

3. The vacuum cleaner of claim 1, wherein movement of the lock member towards the locked position increases a relative spacing between the lock member and the filter housing.

4. The vacuum cleaner of claim 3, wherein the filter housing includes a first cam portion and the lock member includes a second cam portion configured to engage the first cam portion when the lock member moves toward the locked position.

5. The vacuum cleaner of claim 3, wherein the filter housing includes a first plurality of cam portions and the lock member includes a second plurality of cam portions, each of the second plurality of cam portions configured to engage a respective one of the first plurality of cam portions when the lock member moves toward the locked position.

6. The vacuum cleaner of claim 1, wherein the lock member includes a handle configured to be gripped by a user to facilitate movement of the lock member between the locked position and the unlocked position.

7. The vacuum cleaner of claim 1, wherein the filter assembly is located downstream of the motor and fan assembly such that the filter is configured to purify air exhausted from the motor and fan assembly.

8. The vacuum cleaner of claim 1, wherein the movement of the lock member to the locked position moves the tray portion engaging the seal with the housing.

9. A vacuum cleaner comprising:

a motor housing;

a motor and fan assembly supported by the motor housing;

a housing forming a receptacle in fluid communication with the motor housing; and a filter assembly removably insertable into the receptacle, the filter assembly including a filter housing having a tray, a filter disposed within the tray, a seal, and a lock member movable relative to the tray between a locked position and an unlocked position, wherein movement of the lock member towards the locked position increases a relative spacing between the lock member and the tray.

10. The vacuum cleaner of claim 9, wherein movement of the lock member towards the locked position engages the seal with the housing when the filter assembly is inserted in the receptacle.

11. The vacuum cleaner of claim 9, wherein movement of the lock member towards the locked position compresses the seal between the tray and the housing when the filter assembly is inserted in the receptacle.

12. The vacuum cleaner of claim 9, wherein the tray includes a first cam portion and the lock member includes a second cam portion configured to engage the first cam portion when the lock member moves toward the locked position.

13. The vacuum cleaner of claim 9, wherein the tray includes a first plurality of cam portions and the lock member includes a second plurality of cam portions, each of the second plurality of cam portions configured to engage a respective one of the first plurality of cam portions when the lock member moves toward the locked position.

14. The vacuum cleaner of claim 9, wherein the lock member includes a handle configured to be gripped by a user to facilitate movement of the lock member between the locked and unlocked positions.

15. The vacuum cleaner of claim 9, wherein the filter assembly is located downstream of the motor and fan assembly such that the filter is configured to purify air exhausted from the motor and fan assembly.

16. The vacuum cleaner of claim 15, further comprising:

a cord reel housing in fluid communication with the receptacle; and a cord reel disposed within the cord reel housing, the cord reel including a power cord for providing power to the motor and fan assembly, wherein the cord reel housing is located downstream of the filter assembly such that purified air that exits the filter assembly passes through the cord reel housing to cool the cord reel.

17. The vacuum cleaner of claim 9, wherein the filter assembly further includes a front portion movably coupled to the tray such that the tray is movable relative to the front portion along a first axis, and wherein the lock member is movable between the locked position and the unlocked position along a second axis that is normal to the first axis.

18. A method of installing a filter assembly into a vacuum cleaner, the method comprising:

inserting a filter assembly into a receptacle of a vacuum cleaner;

moving a lock member along a first axis relative to a front portion of a filter housing of the filter assembly causing a filter housing to move relative to the lock member along a second axis normal to the first axis;

increasing the distance between the lock member and the filter housing within the receptacle; and compressing a seal disposed on the filter housing.

* * * * *